US006644038B1

(12) United States Patent
Acharya et al.

(10) Patent No.: US 6,644,038 B1
(45) Date of Patent: Nov. 11, 2003

(54) MULTISTAGE PULSE TUBE REFRIGERATION SYSTEM FOR HIGH TEMPERATURE SUPER CONDUCTIVITY

(75) Inventors: Arun Acharya, East Amherst, NY (US); Bayram Arman, Grand Island, NY (US); John Henri Royal, Grand Island, NY (US); Dante Patrick Bonaquist, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/301,712

(22) Filed: Nov. 22, 2002

(51) Int. Cl.[7] ..... F25B 9/00; F25B 7/00
(52) U.S. Cl. ..... 62/6; 62/335
(58) Field of Search ..... 62/6, 259.2, 335

(56) References Cited

U.S. PATENT DOCUMENTS 5,193,349 A * 3/1993 Laverman et al. ..... 62/64
5,508,613 A 4/1996 Kotsubo et al. ..... 324/318
5,575,155 A * 11/1996 Mita et al. ..... 62/6
5,647,218 A 7/1997 Kuriyama et al. ..... 62/6
5,813,234 A * 9/1998 Wighard ..... 62/6
5,966,944 A 10/1999 Inoue et al. ..... 62/51.1
6,205,812 B1 * 3/2001 Acharya et al. ..... 62/607
6,286,318 B1 9/2001 Maguire et al. ..... 62/6
6,336,331 B1 1/2002 White et al. ..... 62/48.2
6,374,617 B1 * 4/2002 Bonaquist et al. ..... 62/6
6,389,819 B1 * 5/2002 Zhu et al. ..... 62/6
6,425,250 B1 7/2002 Acharya et al. ..... 62/6

* cited by examiner

*Primary Examiner*—William C. Doerrler
(74) *Attorney, Agent, or Firm*—Stanley Ktorides

(57) ABSTRACT

A pulse tube refrigeration system wherein the pulse tube working gas is cooled to a defined first stage temperature and is brought to a defined second stage temperature by operation of a regenerator and pulse tube, which are in flow communication through a cold heat exchanger, prior to providing refrigeration to a high temperature superconductor.

4 Claims, 2 Drawing Sheets

MULTISTAGE PULSE TUBE REFRIGERATION SYSTEM FOR HIGH TEMPERATURE SUPER CONDUCTIVITY

TECHNICAL FIELD

This invention relates generally to pulse tube refrigeration which may be used for a high temperature superconductivity application.

BACKGROUND ART

Superconductivity is the phenomenon wherein certain metals, alloys and compounds lose electrical resistance so that they have infinite electrical conductivity. Until recently, superconductivity was observed only at extremely low temperatures just slightly above absolute zero. Maintaining superconductors at such low temperatures is very expensive, typically requiring the use of liquid helium, thus limiting the commercial applications for this technology.

Recently a number of materials have been discovered which exhibit superconductivity at higher temperatures, such as in the range from 15 to 75 K. While such materials may be kept at their superconducting temperatures using liquid helium or very cold helium vapor, such a refrigeration scheme is quite costly. Unfortunately liquid nitrogen, a relatively low cost way to provide cryogenic refrigeration, cannot effectively provide refrigeration to get down to the superconducting temperatures of most high temperature superconductors.

An electric transmission cable made of high temperature superconducting materials offers significant benefits for the transmission of large amounts of electricity with very little loss. High temperature superconducting material performance generally improves roughly an order of magnitude at temperatures of about 30 to 60 K from that at temperatures around 80 K which is achieved using liquid nitrogen.

A recent significant advancement in the field of generating refrigeration is the pulse tube system wherein pulse energy is converted to refrigeration using an oscillating gas. Such refrigeration could be used for high temperature superconductivity applications. However, it is presently quite costly to generate refrigeration for use at the more efficient high temperature superconductivity temperatures using known pulse tube systems thus negating the performance improvement seen at the lower temperatures.

Accordingly, it is an object of this invention to provide an improved pulse tube refrigeration system which can provide refrigeration at temperatures which are conducive to good high temperature superconductivity performance.

SUMMARY OF THE INVENTION

The above and other objects, which will become apparent to those skilled in the art upon a reading of this disclosure, are attained by the present invention, one aspect of which is:

A method for providing refrigeration for high temperature superconductivity comprising:

(A) generating an oscillating pulse tube working gas, and cooling the oscillating pulse tube working gas to a first stage temperature within the range of from 50 to 150 K;

(B) cooling the oscillating pulse tube working gas to a second stage temperature within the range of from 4 to 70 K by direct heat exchange with cold regenerator media to produce cold pulse tube gas;

(C) expanding the cold pulse tube working gas in a pulse tube to generate refrigeration for cooling regenerator media; and (D) providing refrigeration from the cold pulse tube working gas for high temperature super-conductivity.

Another aspect of the invention is:

Apparatus for providing refrigeration for high temperature superconductivity comprising:

(A) a pulse generator for generating oscillating pulse tube working gas, a first stage heat exchanger, means for passing oscillating pulse tube working gas to the first stage heat exchanger, and means for passing refrigeration to the first stage heat exchanger;

(B) a regenerator and means for passing oscillating pulse tube working gas to the regenerator;

(C) a pulse tube in flow communication with the regenerator, said flow communication including a second stage heat exchanger; and (D) means for providing high temperature superconductivity media to the second stage heat exchanger.

As used herein the term "pulse" means energy which causes a mass of gas to go through sequentially high and low pressure levels in a cyclic manner, i.e. to oscillate.

As used herein the term "high temperature superconductivity media" means fluid or other heat transfer media which directly or indirectly provides refrigeration to high temperature superconductor material.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

DETAILED DESCRIPTION

Figure 1:
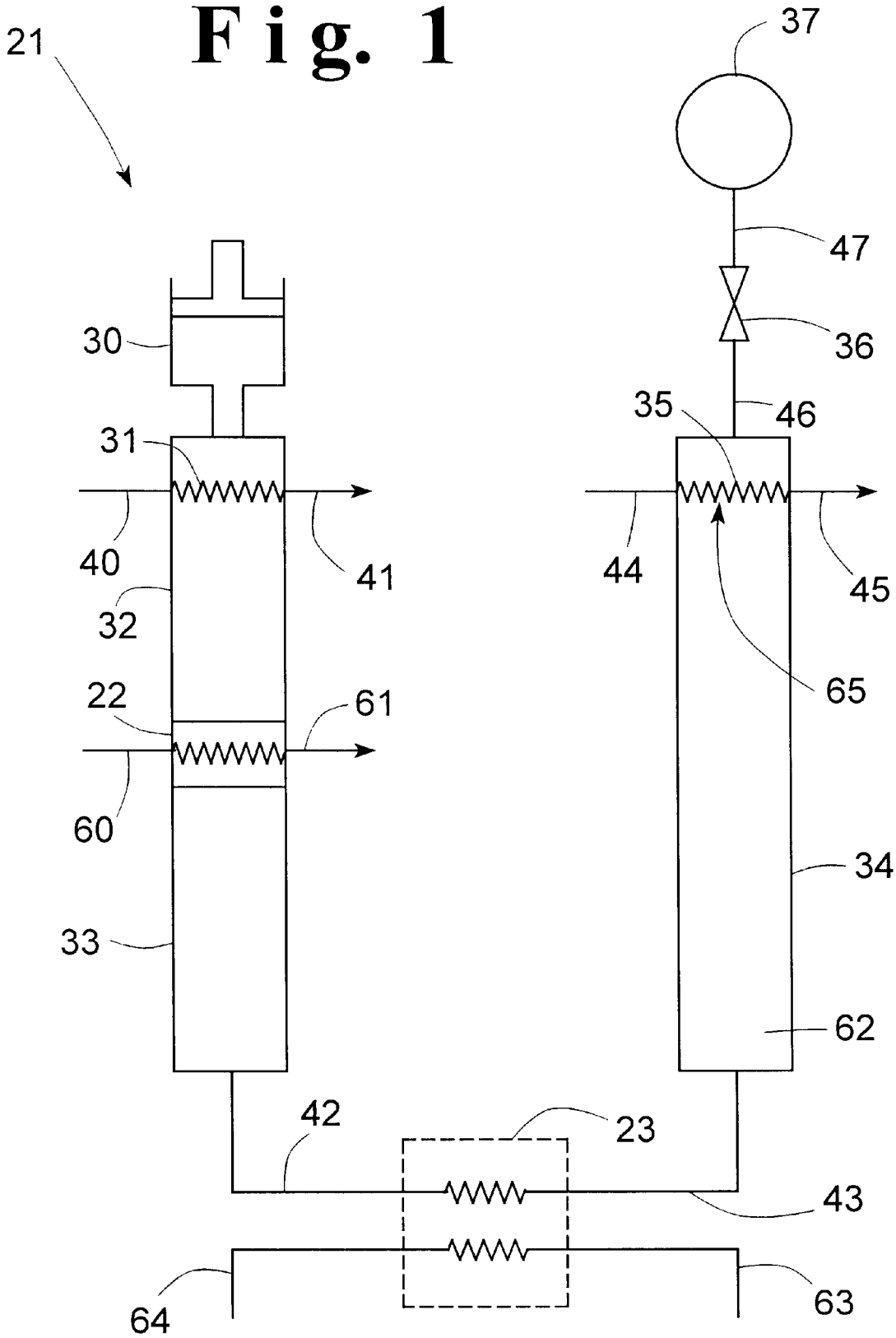
FIG. 1 is a representation of one embodiment of the multistage pulse tube refrigeration system of this invention.

The invention will be described in detail with reference to the Drawings. Referring now to FIG. 1, the multistage pulse tube refrigeration system 21 comprises warm regenerator 32, cold regenerator 33, pulse tube 34, first stage heat exchanger 22 and second stage heat exchanger 23. The regenerators contain pulse tube working gas which may be helium, hydrogen, neon, nitrogen, a mixture of helium and neon, a mixture of neon and nitrogen, or a mixture of helium and hydrogen. Pure helium is the preferred pulse tube working gas.

A pulse, i.e. a compressive force, is applied to the hot end of regenerator 32 by means of pulse generator 30 thereby generating an oscillating pulse tube working gas and initiating the first part of the pulse tube sequence. Preferably, as illustrated in FIG. 1, the pulse is provided by a piston which compresses a reservoir of pulse tube gas in flow communication with regenerator 32. Another preferred means of applying the pulse to the regenerator is by the use of a thermoacoustic driver which applies sound energy to the gas within the regenerator. Yet another way for applying the pulse is by means of a linear motor/compressor arrangement. Yet another means to apply a pulse is by means of a loudspeaker. The pulse serves to compress the pulse tube gas producing hot compressed pulse tube gas at the hot end of the regenerator 32. The hot pulse tube gas is cooled, preferably by indirect heat exchange with heat transfer fluid 40 in heat exchanger 31, to produce warmed heat transfer fluid in stream 41 and to cool the compressed pulse tube gas of the heat of compression. Examples of fluids useful as the heat transfer fluid 40, 41 in the practice of this invention include water, air, ethylene glycol and the like.

Regenerators 32 and 33 contain regenerator or heat transfer media. Examples of suitable heat transfer media in the practice of this invention include steel balls, wire mesh, high density honeycomb structures, expanded metals, lead balls, copper and its alloys, complexes of rare earth element(s) and transition metals.

The pulsing or oscillating pulse tube working gas is cooled in warm regenerator 32 and then is cooled to a first stage temperature within the range of from 50 to 150 K. This cooling, i.e. the provision of refrigeration, may be by any effective means such as conduction cooling. The embodiment of the invention illustrated in FIG. 1 is a preferred embodiment wherein the oscillating pulse tube working gas is passed to first stage heat exchanger 22 wherein it is cooled by indirect heat exchange with refrigerant fluid to a first stage temperature within the range of from 50 to 150 K. In the embodiment of the invention illustrated in FIG. 1, the first stage heat exchanger 22 is shown as being within the housing which holds regenerators 32 and 33. First stage heat exchanger 22 may also be positioned outside of this housing. The refrigerant fluid is provided to first stage heat exchanger 22 in stream 60 and is withdrawn from first stage heat exchanger 22 in stream 61. The refrigerant fluid may be a liquid cryogen such as liquid nitrogen or may be another fluid containing refrigeration generated by a refrigeration system such as a mixed gas refrigeration system, a magnetic refrigeration system or a refrigeration cycle which employs turboexpansion of a working fluid. Heat exchanger 22 can also be cooled by conduction.

The resulting cooled oscillating pulse tube working gas is then passed through cold regenerator 33 wherein it is cooled to a second stage temperature within the range of from 4 to 70 K by direct heat exchange with cold regenerator media to produce cold pulse tube working gas.

Pulse tube 34 and regenerator 33 are in flow communication. The flow communication includes cold or second stage heat exchanger 23. The cold pulse tube working gas passes in line 42 to second stage heat exchanger 23 and in line 43 from second stage heat exchanger 23 to the cold end 62 of pulse tube 34. Within second stage heat exchanger 23 the cold pulse tube working gas is warmed by indirect heat exchange with high temperature superconductivity media thereby providing refrigeration to the high temperature superconductivity media for provision to a high temperature superconductor. The high temperature superconductivity media could be a solid block transmitting heat to heat exchanger 23 from the cooled superconductor system. In the embodiment of the invention illustrated in FIG. 1, the high temperature superconductivity media is a fluid passed to second stage heat exchanger 23 in line 64 and withdrawn from second stage heat exchanger 23 in line 63 in a cooled, i.e. refrigerated, condition. In this case the high temperature superconductivity media could comprise nitrogen, neon, hydrogen, helium and mixtures of one or more of such species with one or more of argon, oxygen and carbon tetrafluoride. A particularly preferred high temperature superconductivity media is a fluid comprising at least 3 mole percent neon.

The pulse tube working gas is passed from the regenerator 33 to pulse tube 34 at the cold end 62. As the pulse tube working gas passes into pulse tube 34 at the cold end 62 it compresses gas in the pulse tube and forces some of the gas through heat exchanger 65 and orifice 36 into the reservoir 37. When the piston moves backward in 30 or in the low pressure point of the compressive pulse, the pulse tube working gas expands and generates a gas pressure wave which flows toward the warm end 65 of pulse 34 and compresses the gas within the pulse tube thereby heating it.

Cooling fluid 44 is passed to heat exchanger 35 wherein it is warmed or vaporized by indirect heat exchange with the pulse tube working gas, thus serving as a heat sink to cool the pulse tube working gas. Resulting warmed or vaporized cooling fluid is withdrawn from heat exchanger 35 in stream 45. Preferably cooling fluid 44 is water, air, ethylene glycol or the like.

Attached to the warm end 65 of pulse tube 34 is a line 46 having orifice 36 leading through line 47 to reservoir 37. The compression wave of the pulse tube working gas contacts the warm end wall of the pulse tube and proceeds back in the second part of the pulse tube sequence. Orifice 36 and reservoir 37 are employed to maintain the pressure and flow waves in phase so that the pulse tube generates net refrigeration during the expansion and the compression cycles in the cold end 62 of pulse tube 34. Other means for maintaining the pressure and flow waves in phase which may be used in the practice of this invention include inertance tube and orifice, expander, linear alternator, bellows arrangements, and a work recovery line with a mass flux suppressor. In the expansion sequence, the pulse tube working gas expands to produce cold pulse tube working gas at the cold end 62 of the pulse tube 34. The expanded gas reverses its direction such that it flows from the pulse tube toward regenerator 33. The relatively higher pressure gas in the reservoir flows through valve 36 to the warm end of the pulse tube 34.

The expanded pulse tube working gas emerging from heat exchanger 23 is passed in line 42 to regenerator 33 wherein it directly contacts the heat transfer media within the regenerator to produce the aforesaid cold heat transfer media, thereby completing the second part of the pulse tube refrigerant sequence and putting the regenerator into condition for the first part of a subsequent pulse tube refrigeration sequence.

Figure 2:
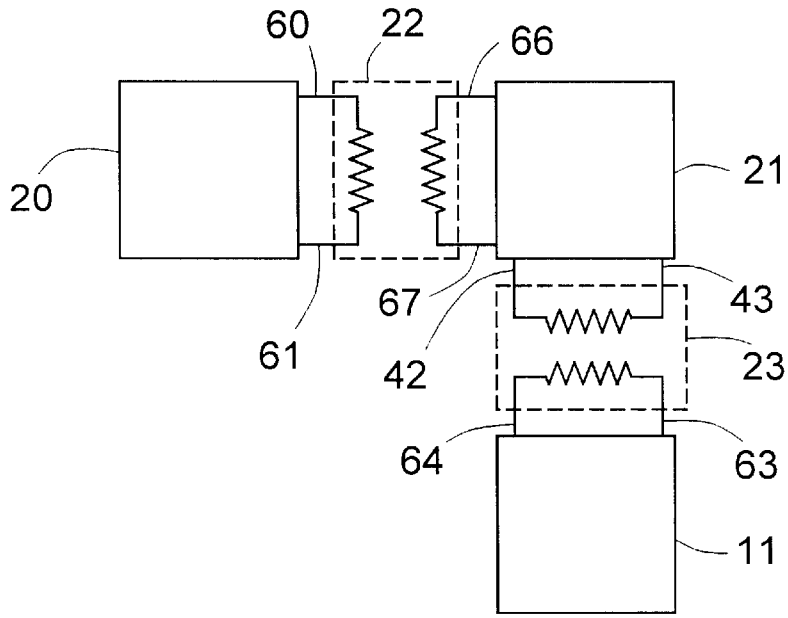
FIG. 2 is a representational diagram of the invention showing an embodiment wherein refrigerant fluid for the first stage heat exchanger is provided from a refrigeration system to forecool a pulse tube refrigerator, which then provides refrigeration to cool a high temperature superconductor system.
Figure 3:
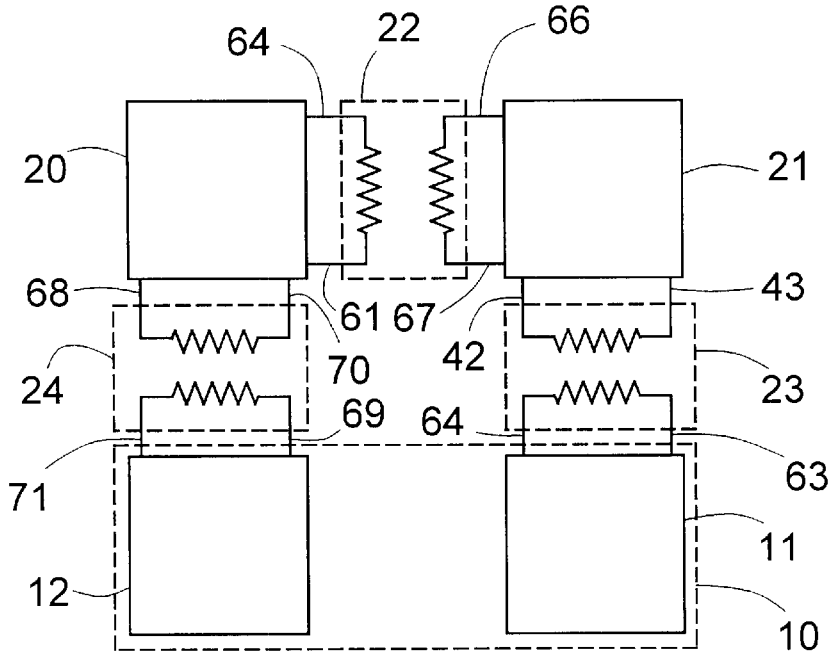
FIG. 3 is a representational diagram of the invention showing an embodiment wherein the refrigerator or the first stage heat exchanger is provided from a first refrigeration system which assists the pulse tube refrigeration system in providing refrigeration to the high temperature superconductivity system. The first refrigerator also provides refrigeration for a second heat exchanger which in turn supplies refrigeration for the superconductor at a higher temperature.

FIGS. 2 and 3 illustrate in simplified representational form two arrangements which may employ the multistage pulse tube refrigeration system of this invention integrated with a higher temperature refrigeration system to provide refrigeration for a high temperature superconductivity application. The numerals in FIGS. 2 and 3 are the same as those of FIG. 1 for the common elements.

Referring now to FIG. 2, higher level refrigeration system 20, for example a mixed gas refrigeration system, produces refrigerant fluid 60 for the first stage cooling in heat exchanger 22 or cools heat exchanger 22 by conductive means. In this embodiment the pulse tube working gas is provided to first stage heat exchanger 22 in line 66 and then passed to the regenerator from heat exchanger 22 in line 67. The refrigerated high temperature superconductivity media in line 64 is provided to high temperature superconductor 11 to maintain superconductivity temperatures generally within the range of from 4 to 70 K and typically within the range of from 30 to 50 K.

FIG. 3 illustrates an arrangement similar to that of FIG. 2 with the added provision of refrigeration from the high temperature refrigeration system 20 to second high temperature superconductivity application 12 which may be a separate entity from application 11 or may be integrated into a single superconducting apparatus 10 which receives refrigeration at two temperature levels. In the embodiment illustrated in FIG. 3, refrigerant fluid from refrigeration system 20 is passed in line 68 to heat exchanger 24 wherein it is warmed to provide refrigeration to fluid 69. The warmed refrigerant fluid is returned to refrigeration system 20 in line 70, and the refrigerated fluid 71 is passed to high temperature superconductivity application 12 wherein it provides refrigeration at a higher temperature than is provided to superconductor 11, typically at about 80 K.

Although the invention has been described in detail with reference to certain preferred embodiments, those skilled in the art will recognize that there are other embodiments of the invention within the spirit and the scope of the claims. For example, there could be employed more than one upstream cooling step or stage prior to the final stage which in the embodiment illustrated in FIG. 1 is the second stage.

What is claimed is:

1. A method for providing refrigeration for high temperature superconductivity comprising:

(A) generating an oscillating pulse tube working gas, and cooling the oscillating pulse tube working gas to a first stage temperature within the range of from 50 to 150 K by indirect heat exchange with refrigerant fluid from a refrigeration system;

(B) cooling the oscillating pulse tube working gas to a second stage temperature within the range of from 4 to 70 K by direct heat exchange with cold regenerator media to produce cold pulse tube gas;

(C) expanding the cold pulse tube working gas in a pulse tube to generate refrigeration for cooling regenerator media; and (D) providing refrigeration from the cold pulse tube working gas for high temperature superconductivity, and wherein the refrigeration system provides refrigeration for another high temperature superconductivity application at a higher temperature than that provided by the cold pulse tube working gas.

2. The method of claim 1 wherein the refrigerant fluid is a liquid cryogen.

3. The method of claim 1 wherein cold pulse tube working gas provides refrigeration for high temperature superconductivity by cooling high temperature superconductivity media which is provided to a high temperature superconductor and wherein the high temperature superconductivity media is a fluid which comprises at least 3 mole percent neon.

4. The method of claim 1 wherein the oscillating pulse tube working gas is cooled to the first stage temperature by indirect conductive heat exchange means.

* * * * *